US006345931B1

(12) United States Patent
Capece

(10) Patent No.: US 6,345,931 B1
(45) Date of Patent: Feb. 12, 2002

(54) AGGREGATE MATERIAL SPREADING MECHANISM

(76) Inventor: Dexter Capece, 208 N. Ray St., New Castle, PA (US) 16101

( * ) Notice: Subject to any disclaimer, the term of this patent is extended or adjusted under 35 U.S.C. 154(b) by 0 days.

(21) Appl. No.: 09/397,774

(22) Filed: Sep. 16, 1999

(51) Int. Cl.[7] ..... E01C 19/12; E01C 19/20
(52) U.S. Cl. ..... 404/101; 404/108; 404/110
(58) Field of Search ..... 404/90, 108, 110, 404/101

(56) References Cited

U.S. PATENT DOCUMENTS

| | | | | | |
|---|---|---|---|---|---|
| 971,338 | A | * | 9/1910 | Adams | 404/110 |
| 1,233,107 | A | * | 7/1917 | Myers | 404/110 |
| 1,487,454 | A | * | 3/1924 | Gardiner | 404/110 |
| 3,208,360 | A | * | 9/1965 | Hayes | 404/110 |
| 3,228,310 | A | * | 1/1966 | Cartwright | 404/110 |
| 3,771,893 | A | | 11/1973 | Miller | 404/222 |
| 3,965,281 | A | | 6/1976 | Takase et al. | 427/106 |
| 4,071,226 | A | * | 1/1978 | Miller | 366/64 |
| 4,124,325 | A | | 11/1978 | Cutler | |
| 4,390,304 | A | | 6/1983 | Jacobson, Jr. et al. | |
| 4,744,693 | A | | 5/1988 | Smith | |
| 5,006,012 | A | | 4/1991 | Sterner | |
| 5,232,306 | A | | 8/1993 | Sterner | |
| 5,234,128 | A | | 8/1993 | Hill | 222/239 |
| 5,387,051 | A | * | 2/1995 | Valente | 404/84.05 |
| 6,027,038 | A | * | 6/1998 | Frankoski et al. | 239/142 |
| 6,113,310 | A | * | 6/1998 | Hesse, Jr. | 404/108 |
| 5,851,085 | A | * | 12/1998 | Campbell | 404/75 |
| 6,050,743 | A | * | 4/2000 | Medinger | 404/108 |

* cited by examiner

*Primary Examiner*—Thomas B. Will
*Assistant Examiner*—Raymond W. Addie
(74) *Attorney, Agent, or Firm*—Cohen & Grisby, P.C.

(57) ABSTRACT

An applicator mechanism for applying a layer of aggregate material on a ground surface comprising an adjustable bracket for mounting the applicator mechanism to a carrying device, a hopper attached to the mounting bracket having a first opening for receiving a supply of aggregate materials said hopper having a second opening for dispensing the aggregate material onto the ground surface, a first shaft attached to the hopper and in communication with the second opening having projections for spreading the aggregate material onto the ground surface through the second opening, a mechanism for driving the first shaft, a second shaft having at least one structure for interacting with the projections in order to control the size or amount of aggregate material exiting the hopper through use of a spring force that adjusts the tension applied to the paddle by way of a handle used to rotate the second shaft, and a mechanism for holding the tension handle in one of several predetermined positions.

7 Claims, 5 Drawing Sheets

AGGREGATE MATERIAL SPREADING MECHANISM

FIELD OF THE INVENTION

The present invention relates to pavement surfacing apparatus and more particularly to a mechanism for applying a layer of aggregate material such as crushed stone, sand, and tar chips to selected areas of an asphalt surface.

BACKGROUND OF THE INVENTION

Pavement resurfacing, typically referred to as "chip sealing," is a common practice in the art of roadway and parking lot maintenance. The process begins with repairing damaged areas such as cracks and pot holes, and then coating the roadway or parking lot with liquid asphalt to seal the paved surface. The attachment of aggregate materials to the coated surface completes the process. Attaching aggregate materials to liquid asphalt coated pavement surfaces has long been used to prevent problems such as slippage between planes of old and new pavement surfaces upon resurfacing, and the characteristic problem of sprayed asphalt having a low coefficient of friction. Chip sealing serves to key the asphaltic overlay to the pavement below to prevent the formation of a slippage plane. Chip sealing also eliminates slippery conditions that typically occur on roads, highways and parking lots at curves, traffic lights, and railroad crossings.

The aggregate material used in chip sealing is usually selected from hard, durable material such as crushed stone or sand, or tar chips which provide the extra advantage of efficiently resurfacing an asphalt surface with a product that can be recycled from the site. The aggregate particles are generally selected between ⅛ to ⅜ inch in size to provide a relatively compact packing of the aggregate on the asphalt surface. Larger aggregates and mixtures of different sizes of aggregate may be used to achieve different levels of compactness. This compact packing provides a surface smooth enough to provide a comfortable ride for vehicles traveling on the surface while at the same time providing small channels for water to escape so that hydroplaning and a loss of traction can be avoided by automobiles and pedestrians alike.

While chip sealing typically requires large equipment to cover large areas of pavement efficiently, this equipment cannot effectively resurface the edges, corners, and areas around immovable obstacles. These hard to reach areas must typically be resurfaced manually, or left free of an aggregate seal. However, a small mechanism similar to the large paving equipment used to spread aggregate over these areas could solve this problem to protect these hard to reach pavement surfaces.

DESCRIPTION OF THE PRIOR ART

Equipment used in pavement resurfacing is typically very large and expensive to operate. For example, a chip spreader vehicle that is commonly used in maintenance projects is a highly specialized automotive vehicle having a chip receiving bin on its back end, a chip dispensing hopper with a power driven auger therein on its front end, and a conveyor system for conveying the chips from the receiving bin to the dispensing hopper. A conventional dump truck is backed up so that its tail gate end is adjacent the chip receiving bin of the chip spreading vehicle, and its dump bed is raised to deliver the chips at a controllable delivery rate into the chip receiving bin. The dump truck is connected to the chip spreading vehicle and is towed by the vehicle as it is operated to accomplish its chip spreading task. This type of highly specialized vehicle is very expensive both from its initial cost and operating cost standpoints and its use is usually reserved for relatively large jobs.

Another commonly used chip spreader mechanism, typically referred to as a "tailgate spreader," is mounted on the back of a dump truck to convert it into a special use machine.

In both of the above devices, the objective is to spread a layer of chips on large areas of the paved surface. But, the use of either one of these prior art machines cannot be economically justified for spot repair work, shoulder work, or work in hard to reach areas of paved surfaces. Thus, pavement resurfacing on the small scale is usually accomplished by first cleaning the surface and then repaving with an asphalt/aggregate mix, leveling it by hand, and finishing the repair by rolling it with a hand operated roller. Since no mechanized equipment for applying an asphalt seal coating and applying a chip coating is available for such small scale work, the chip seal coating is simply omitted. In the absence of such a coating, the repaired areas are subject to relatively rapid deterioration due to traffic and environmental damage. Therefore, a need exists for an efficient mechanism for applying a layer of aggregate to selected areas of a paved surface.

SUMMARY OF THE INVENTION

In accordance with the present invention, a new and useful mechanism is disclosed for applying a layer of aggregate material on selected areas of a paved surface that has been repaired and sealed with a spray coating of uncured liquid asphalt. The applicator mechanism includes an adjustable mounting bracket allowing the mechanism to operate with machines such as skid loaders, front loaders, and the like. A hopper is carried by the mounting bracket and is configured to provide an elongated aggregate dispensing slot on its lower end. A spreader shaft is mounted transversely to the intended movement path of the mechanism and attached by bearings to the inside surfaces of the hopper side walls. The spreader shaft contains a plurality of projections and is driven by a motor.

Working in combination with the spreader shaft are paddles in communication with one or more tension springs to control the size and amount of aggregate leaving the hopper. One end of the paddles surround a separate paddle shaft. A tension handle attached to one end of the paddle shaft allows the springs to be turned in a manner to increase or decrease the force applied to the paddles. The tension handle in turn works in combination with a toothed rack to hold the tension handle in one of several predetermined positions. Accordingly, an object of the present invention is to provide a new and useful mechanism for applying a layer of aggregate on selected areas of a paved surface.

Another object of the present invention is to provide a new and useful applicator mechanism of the above described character having a spreader shaft assembly for spreading the aggregate in a uniform layer.

Another object of the present invention is to provide a new and useful applicator mechanism of the above described character having a paddle shaft means to variably adjust the size and volume of aggregate deposition onto the spreader shaft and thus onto a paved surface.

Another object of the present invention is to provide a new and useful applicator mechanism of the above described character having a tension handle to variably adjust the tension applied to the paddles thereby controlling the thickness of the aggregate spread on a paved surface.

Yet another object of the present invention is to provide a new and useful applicator mechanism of the above described character having an adjustable mounting bracket to allow attachment to many different machines and allowing manipulation of the applicator mechanism to apply a layer of aggregate in an uncured coating of liquid asphalt previously applied on the selected area of the paved surface.

The foregoing and other object of the present invention, as well as the invention itself may be more fully understood from the following description when read in conjunction with the accompanying drawings.

BRIEF DESCRIPTION OF THE DETAILED DRAWINGS

FIG. 1 is a side view of the present invention showing the features thereof.

FIG. 2*a* is a cross-section of the spreader shaft showing other structural details thereof.

FIG. 2*b* is a perspective view of the spreader shaft showing attached sprocket, projections, and its relationship with bearing retainer plates.

DETAILED DESCRIPTION OF THE DRAWINGS

Figure 1:
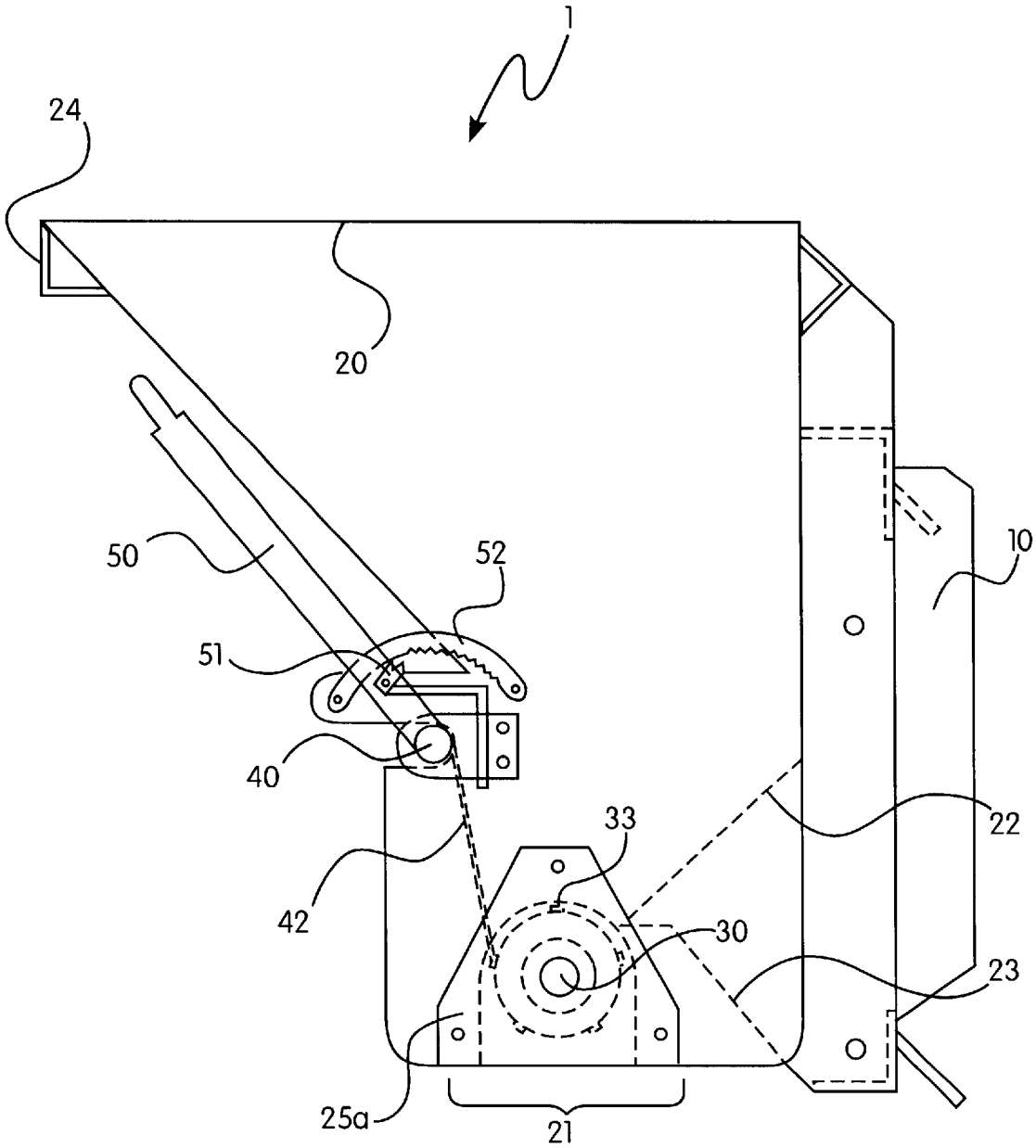

FIG. 1 shows the aggregate material applicator mechanism of the present invention which is indicated generally by the reference numeral 1. Generally, the applicator mechanism 1 includes an upwardly opening hopper structure 20 that is attached to a mounting bracket 10 that contains a plurality of brackets so that any number of carrying devices can be adapted for use of the applicator mechanism thus allowing use of the hopper 20 with devices such as front loaders, back loaders, and skid loaders intended for use in resealing areas that cannot be treated by conventional large scale sealing equipment. An elongated dispensing slot 21 is formed in the bottom of the hopper structure 20 where aggregate material exits. Within the hopper structure 20, an upper internal wall 22 is shown for directing aggregate material toward the dispensing slot 21, and to provide space to accommodate motor 61 shown in FIG. 5. Bearing retainer plates 25*a* and 25*b* are placed on opposite ends of the length of the dispensing slot 21 to reinforce hopper structure 20 and to carry spreader shaft assembly 30. Bearing retainers 26*a* and 26*b* are attached at a predetermined location on bearing retainer plates 25*a* and 25*b* respectively to hold commonly used bearing assemblies 27 such as needle bearing or ball bearing assemblies. Optional reinforcing bar 23 and optional reinforcing angle 24 are also shown.

Figure 2A:
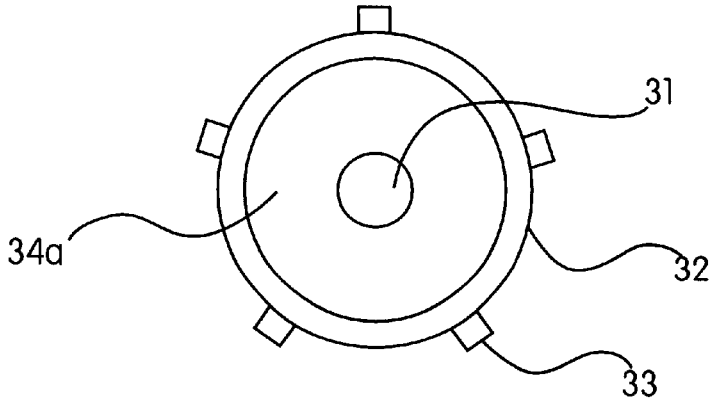
Figure 2B:
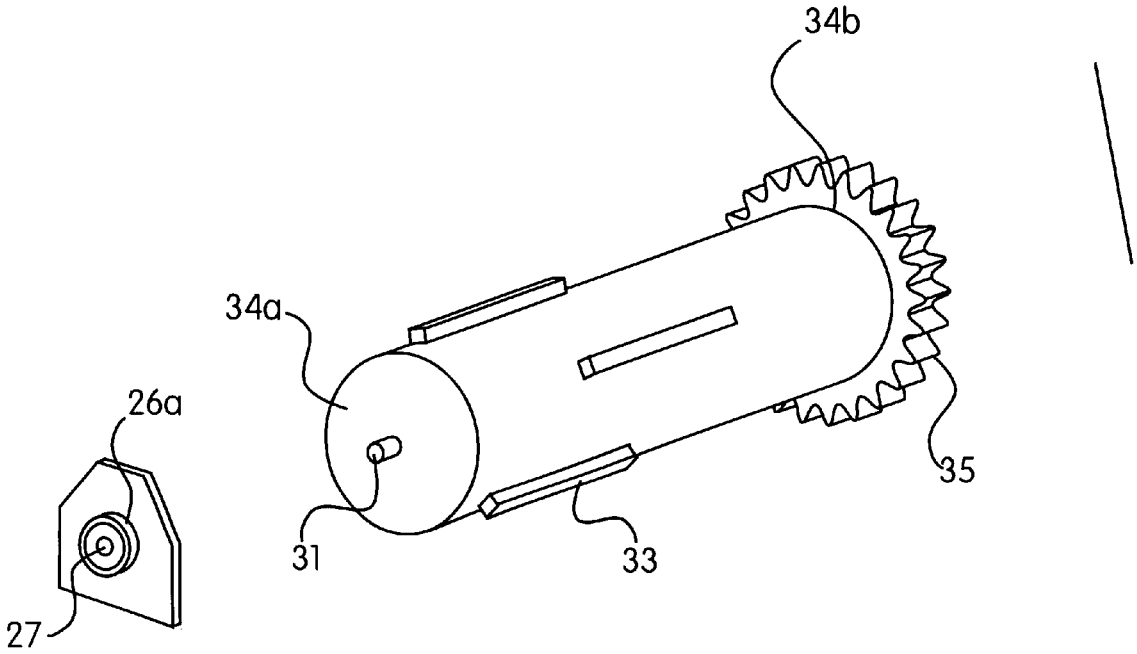

Above dispensing slot 21 is contained the spreading shaft assembly indicated generally by the reference numeral 30. The preferred embodiment of the spreader shaft assembly 30 detailed in FIG. 2*a* shows inner shaft 31 encompassed by outer shaft 32 upon which projections 33 are attached to the outer surface. FIG. 2*b* shows end caps 34*a* and 34*b* having center holes into which inner shaft 31 is placed and having an outer edge that forms an attachment for outer shaft 32 concentric with inner shaft 31 to radially align outer shaft 32 to inner shaft 31 as inner shaft 31 is placed into bearing assembly 27. Onto end cap 34*b* is attached chain sprocket 35 having a center hole into which shaft 31 is also placed. Each end of inner shaft 31 is placed inside a bearing assembly 27 and thus carried in the hopper structure by attachment to bearing retainer plates 25*a* and 25*b*. Alternatively, the inner and outer shafts could be integrated into a unitary construction.

Figure 3:
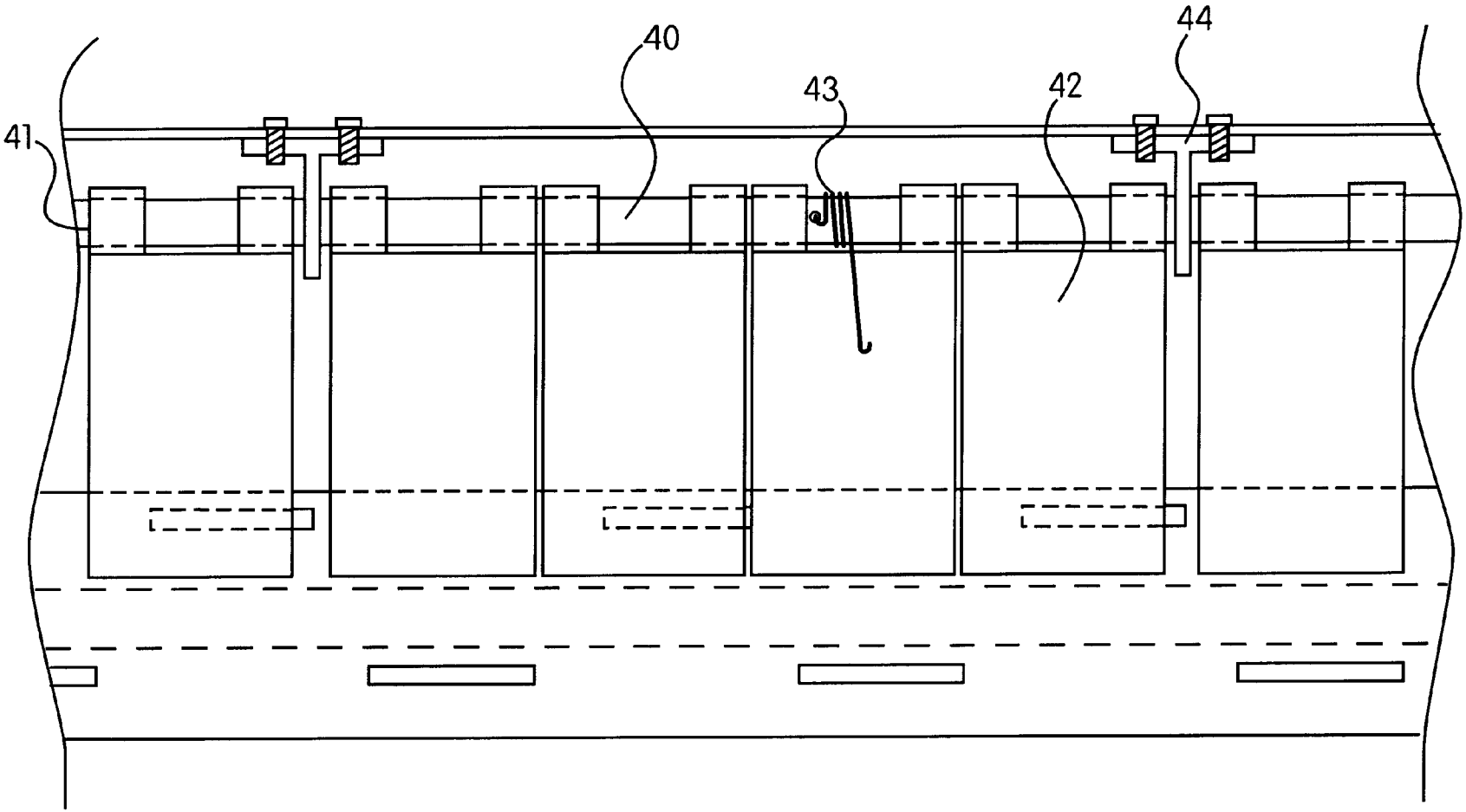
FIG. 3 is a top view of the paddle shaft in communication with the spreader shaft which also shows various features of the tension springs and paddles.
Figure 4:
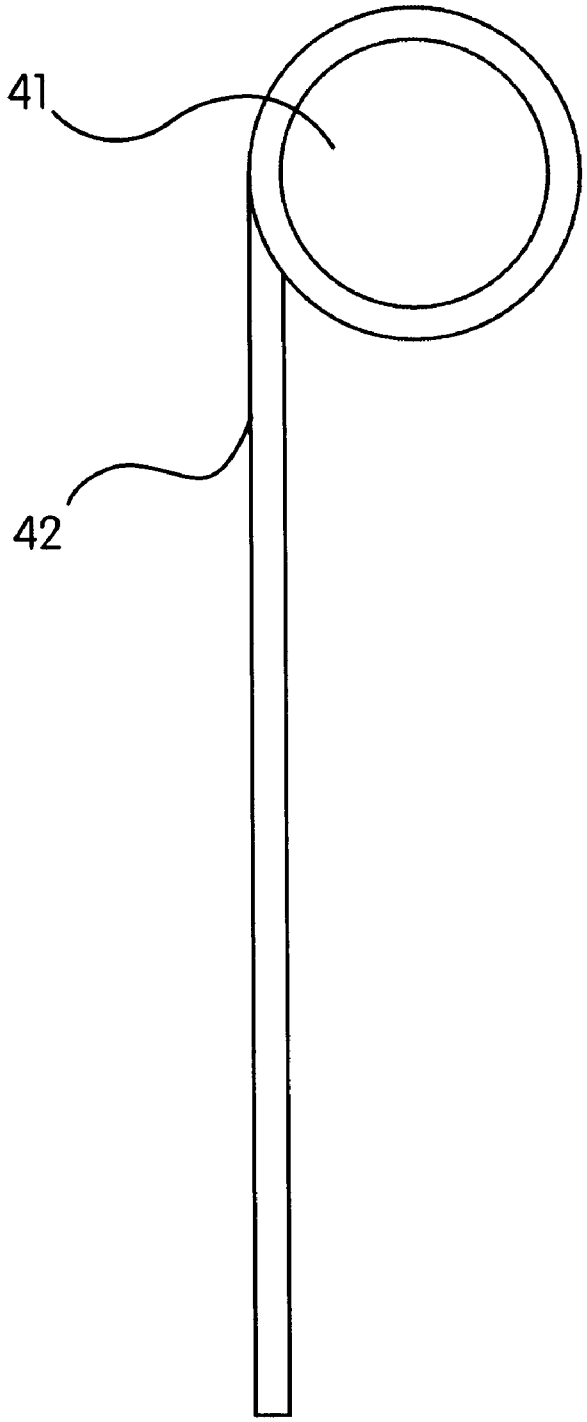
FIG. 4 is an end view of a paddle.

Working in communication with the spreading shaft assembly 30 is a paddle shaft assembly indicated generally by the reference numeral 40. The paddle shaft assembly 40 detailed in FIG. 3 shows support shaft 41 carrying one or more paddles 42 made of a strip of metal or other malleable or plastic material. A side view of paddle 42 shown in FIG. 4 shows the rolled end of paddle 42 with an inner rolled diameter slightly larger than the support shaft 41 to accommodate freedom of rotation over the support shaft 41. Coiled about support shaft 41 are one or more tension springs 43 that have one end either permanently or nonpermanently attached to support shaft 41 and another elongated end applying a spring force against one side of paddle 42. Support shaft 41 may be fastened to hopper structure 20 by retaining plates similar to 25*a* and 25*b*, T bars 44 attached to the hopper walls, or by similar means that allow free rotation of support shaft 41 inside paddles 42 and the coils of springs 43.

To one end of support shaft 41 is attached tension handle 50. Tension handle 50 applies torque to tension springs 43 and subsequently to paddles 42. This is accomplished by moving the tension handle 50 to radially rotate support shaft 41 thereby adjusting the tension of spring 43 to tighten or relax the spring coil and thus increase or decrease the force applied to paddle 42 by the opposite end of tension spring 43. Latch 51 is attached to tension handle 50 so that it is engaged by one of the teeth of curved rack 52 to hold tension handle 50 in a fixed position.

Figure 5:
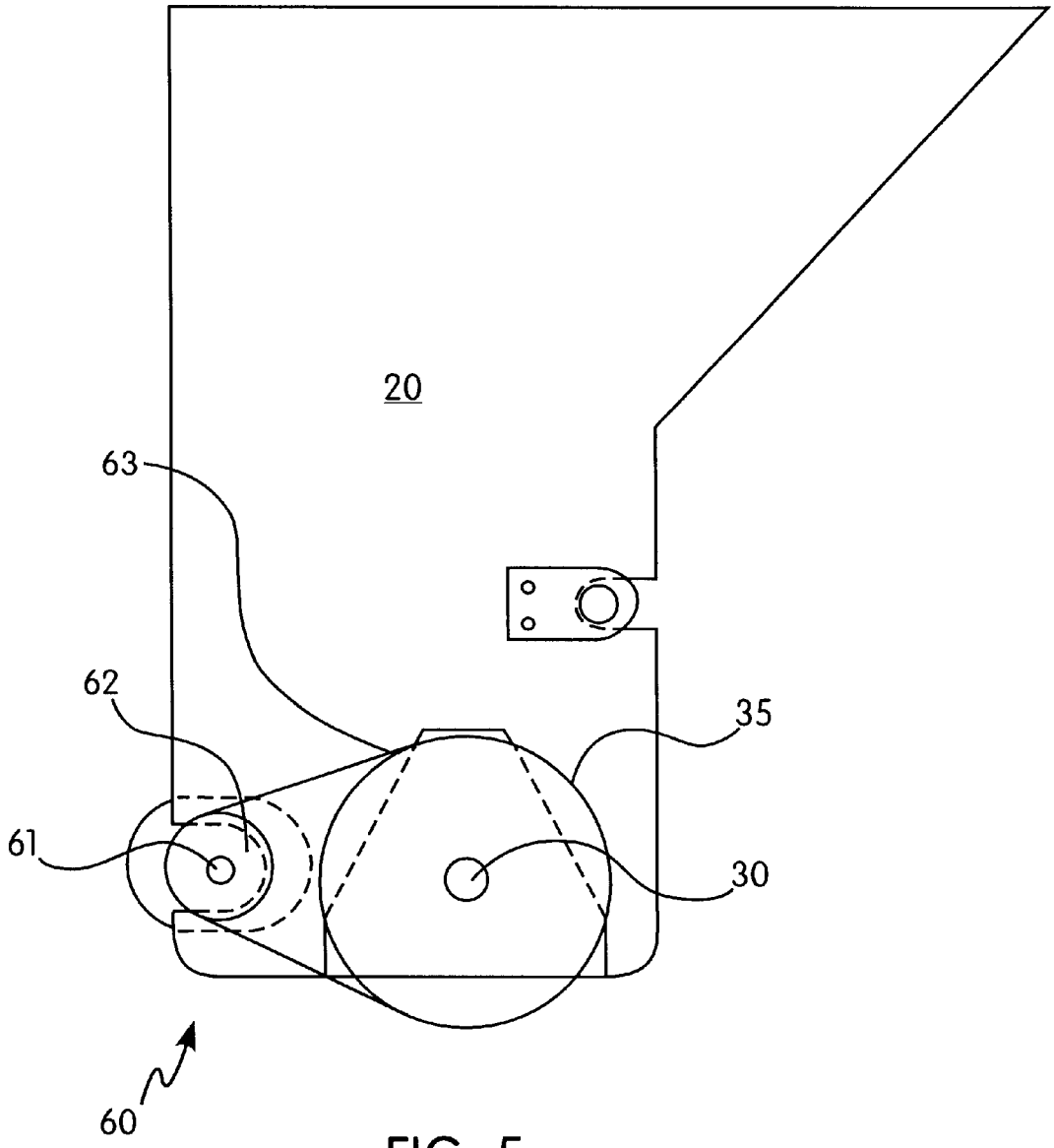
FIG. 5 is a side view of the present invention partially broken away to show the various features of the drive mechanism.

FIG. 5 depicting the drive mechanism assembly indicated generally by the reference numeral 60 shows motor 61 with attached chain sprocket 62 driving a chain 63 over spreader shaft chain sprocket 35 thus rotating spreader shaft assembly 30. Motor 61 is removably attached to hopper structure 20 for ease of removal and maintenance.

Aggregate material is loaded into hopper structure 20 and is directed by gravity toward the spreader shaft and held in place by internal wall 22 and paddles 42. As spreader shaft assembly 30 rotates beneath the aggregate material, projections 33 force aggregate particles toward paddles 42. The size and the volume of particles able to pass paddles 42 depends upon the force tension springs 43 apply to paddles 42. An increased tension will force paddles 42 against projections 33 to reduce the volume of aggregate through dispensing slot 21, while a decreased tension will relax paddles 42 to allow a larger volume of aggregate through dispensing slot 21 per unit time. The size of particles dispensed through dispensing slot 21 is varied in the same manner. By fixing the force applied by tension springs 43 to paddles 42 via tension handle 50 remaining in a fixed position, a consistent size and volume of aggregate can be automatically controlled while the entire applicator mechanism 1 is being directed toward selected areas of pavement ready to receive the aggregate material. Accordingly, the present invention is not intended to be limited in scope by the description of the preferred embodiment provided above, but rather only by the claims that follow.

What is claimed is:

1. An applicator mechanism for applying a layer of aggregate material on a ground surface comprising:

a. a bracket for mounting the applicator mechanism to a carrying device;

b. a hopper attached to the mounting bracket having a first opening for receiving a supply of aggregate materials said hopper having a second opening for dispensing the aggregate material onto the ground surface;

c. a spreading shaft attached to the hopper and in communication with the second opening having projections attached to said spreading shaft for spreading the aggregate material onto the ground surface through the second opening; and d. a paddle shaft having at least one member in contact with the projections so as to apply a varying force against said projections in order to control the size or amount of aggregate material exiting the hopper through use of a tensioning mechanism that adjusts the force applied to the projections by said at least one member.

2. The applicator mechanism of claim 1 wherein the hopper is upwardly opening.

3. The applicator mechanism of claim 1 wherein the second opening is an elongated slot formed in the bottom of the hopper which extends transversely to the intended movement of the hopper.

4. The applicator mechanism of claim 1 wherein the spreading shaft is attached to the hopper transversely to the intended movement of the hopper.

5. An applicator mechanism for applying a layer of aggregate material on a ground surface comprising:

a. a mounting bracket for attachment to a carrying means;

b. an upwardly opening hopper structure attached to the mounting bracket for receiving a supply of aggregate materials, the hopper structure having an elongated materials dispensing slot formed in the bottom thereof which extends transversely to the intended movement of the hopper;

c. a spreading shaft attached to the hopper structure, and parallel to the dispensing slot and having projections attached to said spreading shaft for controlling the uniformity of flow of aggregate materials through the dispensing slot;

d. a drive mechanism comprised of a motor, chain sprocket, and chain for driving the spreading shaft;

e. a paddle shaft having at least one member in contact with the projections so as to apply a varying force against said projections and having a tension handle attached to the paddle shaft for manipulating a force used to adjust the tension applied by a tensioning mechanism through the paddle shaft to the spreading shaft to control the rate, size, or volume of aggregate materials exiting the hopper structure; and f. a means for holding the tension handle in one of several predetermined positions.

6. The applicator mechanism of claim 1 or 5 wherein the spreading shaft comprises:

a. a pipe;

b. attached projections;

c. bearings attached to a first end of the pipe and to a second end of the pipe; and d. a chain sprocket attached radially to one end of the pipe.

7. The applicator mechanism of claim 1 or 5 wherein the paddle shaft comprises:

a. a pipe;

b. said at least one member comprising a plurality of rectangular strips attached to the pipe; and c. said tensioning mechanism comprising one or more tension springs having a first end encircling the pipe and a second end in contact with the rectangular strips so as to vary the force applied by said rectangular strips against said projections by adjusting the amount of tension applied by said spring through said contact.

* * * * *